US006471191B1

(12) United States Patent
Rotzler et al.

(10) Patent No.: US 6,471,191 B1
(45) Date of Patent: Oct. 29, 2002

(54) CABLE GUIDE ARRANGEMENT HAVING A CABLE GUIDE CHANNEL ARRANGED IN A DETACHABLE INSERT

(75) Inventors: Jürgen Rotzler, Steinen (DE); Ralf Brutschin, Grenzach-Wyhlen (DE); Dietmar Kessler, Schopfheim (DE)

(73) Assignee: Rotzler GmbH & Co. Spezialfabrik für Seilwinden und Hebezeuge, Steinen (DE)

( * ) Notice: Subject to any disclaimer, the term of this patent is extended or adjusted under 35 U.S.C. 154(b) by 0 days.

(21) Appl. No.: 09/522,739

(22) Filed: Mar. 10, 2000

(30) Foreign Application Priority Data

Mar. 12, 1999 (DE) ..... 199 11 073

(51) Int. Cl.[7] ..... B66D 3/04
(52) U.S. Cl. ..... 254/389; 226/196.1
(58) Field of Search ..... 254/225, 389; 43/24; 242/157 R, 224, 615, 615.4; 226/196.1

(56) References Cited

U.S. PATENT DOCUMENTS 4,317,549 A * 3/1982 Thomas ..... 242/157 R
4,450,702 A * 5/1984 Larson et al. ..... 242/157 R
4,568,036 A * 2/1986 Kearney ..... 254/389
4,610,134 A * 9/1986 Busch et al. ..... 57/417
4,706,940 A * 11/1987 Harig ..... 254/389
4,742,993 A * 5/1988 Montgomery et al. ..... 254/289
5,186,406 A * 2/1993 Romanelli ..... 242/157 R
5,482,227 A * 1/1996 Hystad ..... 254/389
5,671,878 A * 9/1997 Kawasaki ..... 226/196.1
5,863,029 A * 1/1999 Fanger et al. ..... 254/389
6,035,625 A * 3/2000 Schlomer et al. ..... 57/417

FOREIGN PATENT DOCUMENTS

DE 41908 * 10/1965 ..... 254/389
DE G 91 00 261.3 5/1991
GB 816724 * 7/1959 ..... 254/389
SU 187980 * 1/1966 ..... 254/389

* cited by examiner

*Primary Examiner*—Emmanuel M. Marcelo
(74) *Attorney, Agent, or Firm*—Gudrun E. Huckett

(57) ABSTRACT

A cable guide arrangement for a cable winch has a housing to be mounted relative to a cable winch such that a first end of housing faces the cable winch and a second end of the housing faces away from the cable winch. A cable guide channel penetrates the housing and has a closed circumferential wall. The cable guide channel has a longitudinal center axis extending perpendicularly to the first and second ends of the housing. The cable guide channel has open end portions at the first and second ends of the housing, respectively. The open end portion of the guide channel at the second end of the housing widens in a direction away from the cable winch to form an inlet funnel having an edge portion defining a funnel opening. The inlet funnel reduces wear on the cable especially when being pulled at a slant to the center axis through the cable guide arrangement.

12 Claims, 4 Drawing Sheets

CABLE GUIDE ARRANGEMENT HAVING A CABLE GUIDE CHANNEL ARRANGED IN A DETACHABLE INSERT

BACKGROUND OF THE INVENTION

1. Field of the Invention

The invention relates to a cable guide arrangement for a cable winch comprising a housing to be arranged fixedly in front of the cable winch and having a cable guide member for the cable.

2. Description of the Related Art

A cable guide arrangement is provided for the purpose of a defined guiding action of the cable that has been removed from the cable winch. The portion of the traction cable withdrawn from the winch apparatus and force-loaded by the cable winch exits through the cable guide arrangement, wherein the cable guide arrangement is arranged in a certain predetermined position relative to the cable winch.

Such a cable guide arrangement is known from German patent document GM 91 00 061. This known device is arranged in a fixed position in front of the cable winch. The housing of the cable guide arrangement is secured, for example, to a base plate on which the cable winch is supported. The cable guide arrangement is comprised of a roller pair supported on bolts arranged in the housing. The traction cable is guided between the two rollers.

It has been found repeatedly that the traction cable of prior art cable winches with cable guide arrangements experiences rapid wear during operation, in particular, when the cable is frequently pulled at a slant. Moreover, the cable frequently breaks at greater deflection angles of the cable relative to the winding direction onto the cable winch.

SUMMARY OF THE INVENTION

It is therefore an object of the present invention to further develop the cable guide arrangement of the aforementioned kind such that the operating costs for the cable winch are lowered and, in particular, the service life of the cable guided through the guide arrangement is increased even under slanted pulling conditions.

In accordance with the present invention, this is achieved in that the cable guide is embodied as a cable guide channel having a continuous circumferential wall which penetrates the housing and whose end portion facing away from the cable winch is formed as an inlet funnel.

When forming the cable guide as a continuous circumferential cable guide channel which penetrates the housing of the cable guide arrangement, the end portion of the cable guide channel facing away from the cable winch is formed as an inlet funnel which widens in the outward direction (relative to the housing interior) so that the cable guided in the cable guide channel passes through the cable guide arrangement with minimal cable friction in any possible deflection position relative to the longitudinal axis of the cable guide oriented toward the cable winch. The configuration of the inlet funnel with a funnel wall having a curvature that curves inwardly, i.e., toward the interior of the cable guide channel, in a way similar to the hyperbola of the flared bell of a trumpet, provides especially favorable inlet and guiding conditions with minimal stress on the loaded traction cable.

The inventive cable guide arrangement can be produced (and mounted) in a simple manner because it does not comprise any movable parts. The cable guide arrangement can be formed as a unitary part by providing the cable guide channel within the housing itself. According to an advantageous configuration of the cable guide arrangement, the cable guide channel is provided within an insert which can be detachably mounted in the housing. When taking into consideration the forces which act on the cable and the cable guide channel, especially onto the funnel wall, the insert can preferably be provided in the form of a wear component that can be manufactured inexpensively and exchanged, if needed, with minimal labor expenditure. Metal, wood, or plastic can be used expediently as the material for such an insert; however, any other suitable material can be used. When mounting the cable guide arrangement, the component halves forming the insert are combined while enclosing or surrounding the cable and are then inserted into the housing. The cable to be withdrawn from the cable winch has previously been threaded through the housing. The housing can also be of a divided (multi-part) construction in order to facilitate its mounting and also the threading of the cable through the housing.

The outer mantle surface of the insert is advantageously conically pointed in a direction away from the inlet funnel. The inner mantle of the housing is correspondingly conically shaped so that the insert is positive lockingly secured in the housing in the pulling direction of the cable winch.

BRIEF DESCRIPTION OF THE DRAWING

One embodiment of the invention will be explained in more detail in the following with the aid of the accompanying drawings.

In the drawing.

DESCRIPTION OF THE PREFERRED EMBODIMENTS

Figure 1:
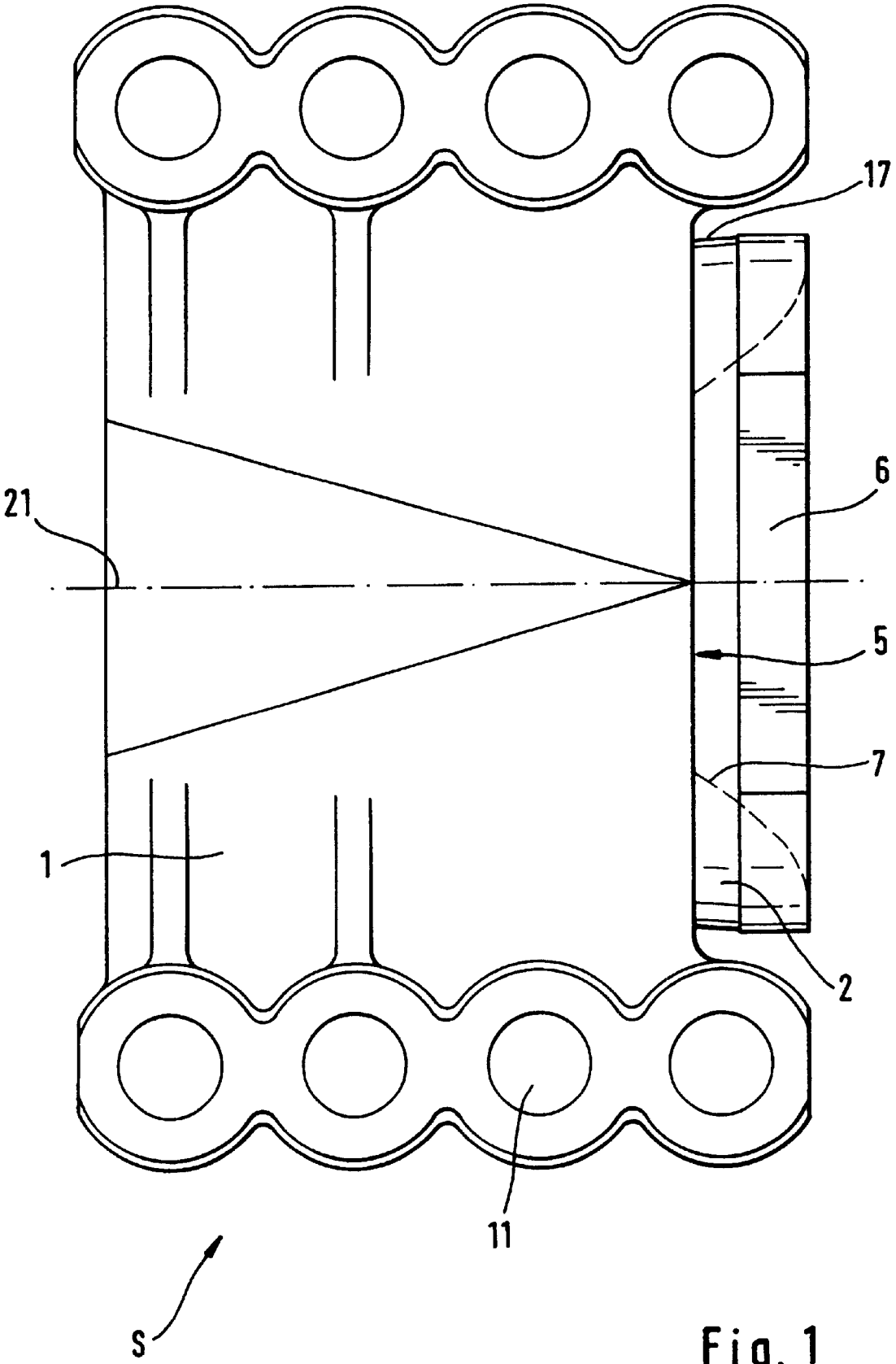
FIG. 1 is a plan view onto the housing of the cable guide arrangement according to the present invention.
Figure 2:
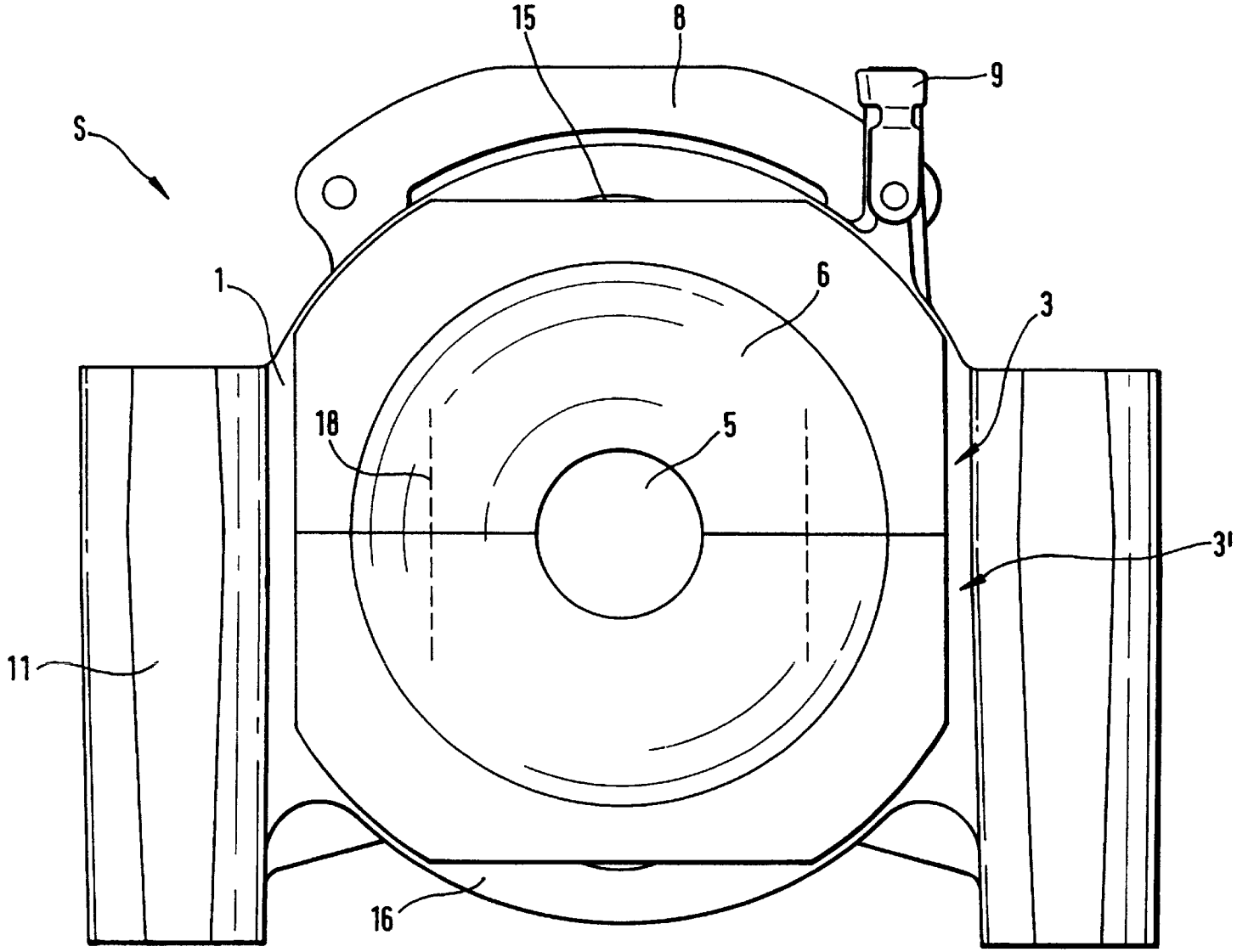
FIG. 2 is a front view of the cable guide arrangement according to FIG. 1.
Figure 3:
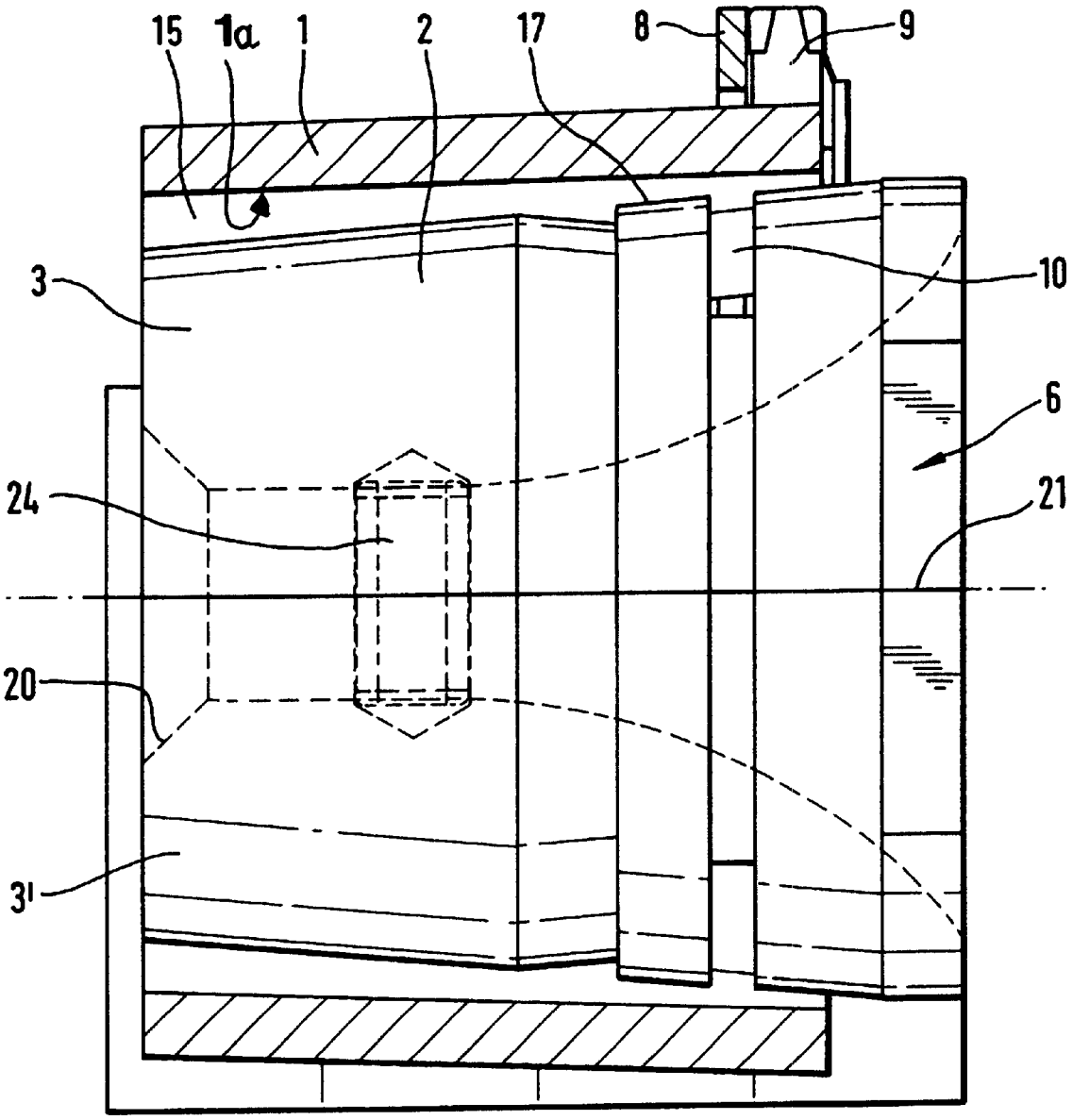
FIG. 3 is a longitudinal section of the cable guide arrangement according to FIG. 1.

The FIGS. 1 through 3 show a circumferentially closed housing 1 of a cable guide arrangement S for cable winches. The same reference numerals are used for same components in the different Figures, respectively. In the interior 15 of the housing 1 an insert 2 in the form of a guide sleeve is received. The cable guide arrangement S is fixedly mounted in front of a cable winch for securely guiding the cable in the winding and unwinding direction of the cable winch. The housing 1 of the cable guide arrangements can be rigidly connected to the support frame of the cable winch or can be connected to the apparatus housing of the cable winch.

The housing 1 of the cable guide arrangement comprises screw or bolt channels 11 for receiving screw or bolt shafts of clamping screws or bolts in order to fasten the cable guide arrangement in the desired position relative to the working direction of the cable winch. The housing 1 can be connected to a support with corresponding clamping screws or bolts wherein the support, for example, a base plate or console, has threaded bores correlated with the screw or bolt channels 11 for receiving the screw or bolt shafts. The screw or bolt channels 11 with their throughbores are arranged in pairs perpendicular to the working direction of the cable winch. However, it may also be expedient in certain situations to arrange the fastening points of the cable guide arrangement parallel to the working direction of the cable winch.

The guide sleeve (insert) 2 is almost completely received in the housing 1 and projects with one end from the housing 1, as can be seen especially in FIG. 1. The insert 2 can thus be removed from the housing 1 with minimal labor expenditure when servicing is needed or when the insert is to be exchanged because it is worn. The insert 2 can also have recesses or cutouts or similar engagement locations for positive lockingly receiving a tool in order to move the guide sleeve (insert) 2 in the housing 1, if needed.

The insert 2 is secured in the interior 15 of the housing 1 by a securing bracket 8 or other fastening elements which project into the interior 15 of the housing 1. The securing bracket 8 is approximately U-shaped. In the securing position of the bracket 8, its two legs engage groove-like cutouts 10 provided in the outer mantle surface 17 of the insert 2 in order to secure the guide sleeve (insert) 2 in the housing 1 in its proper position. The securing bracket 8 is locked in the engaged position by a locking latch 9 which is fastened to the housing 1. The locking latch 9 can be pivotably mounted on the housing 1.

The insert 2 has radial symmetry. The guide channel 5 in the interior of the insert 2 is widened to form an inlet funnel 6 at the side facing away from the cable winch. The cable guide channel 5 will be explained later in more detail in this description with the aid of FIG. 4.

The guide sleeve (insert) 2 which is symmetrical to its longitudinal center axis 21 has a conical outer mantle surface 17, and the inner mantle surface 1*a* of the housing 1 is also formed conically to match the outer conical mantle surface 17. The pointed end of the insert 2 as well as of the inner mantle surface 1*a* of the housing 1 face the cable winch. The insert 2 is thus secured in a positive locking manner against pulling loads within the housing 1 so that the pulling forces occurring during operation of the cable winch can be introduced into the housing 1.

The guide sleeve (insert) 2 is comprised of two identical halves 3, 3' which can be combined at their common separation plane. During mounting of the cable guide arrangement, the cable is threaded through the housing 1 and the insert halves 3, 3' are then combined with one another (connected to one another) at the side of the housing 1 facing away from the cable winch to form the guide sleeve 2 surrounding and enclosing the cable. The thus formed insert 2 is then introduced into the interior 15 which widens correspondingly to the widening configuration of the conical outer mantle surface of the guide sleeve (insert 2) in the direction toward the end face 16. The sleeve halves 3, 3' of the insert 2 are detachably connected to one another by connecting pins 24.

The cutouts 10 at the circumference of the guide sleeve (insert) 2, provided for a positive locking engagement of the legs of the securing bracket 8, are embodied as circumferentially arranged notches with different penetration depths. The opening width required for receiving the legs of the securing bracket 8 is provided in uniform rotational angle spacing about the circumference of the insert 2. During assembly, the insert 2 is oriented in the respective rotational angle position so that the legs of the securing bracket 8 can engage the notches indicated in FIG. 2 by the dashed lines identified by reference numeral 18. Four such notches 18 are positioned at the circumference of the guide sleeve (insert) 2. The insert 2 is thus rotatable in rotational angle steps of 90°. However, any other suitable number of notches can be expedient. When the insert 2 exhibits wear after an extended operating time of the cable winch, it is possible to rotate the insert 2 such that a less worn portion is positioned in the area of the cable guide arrangement subjected to greater loads.

Figure 4:
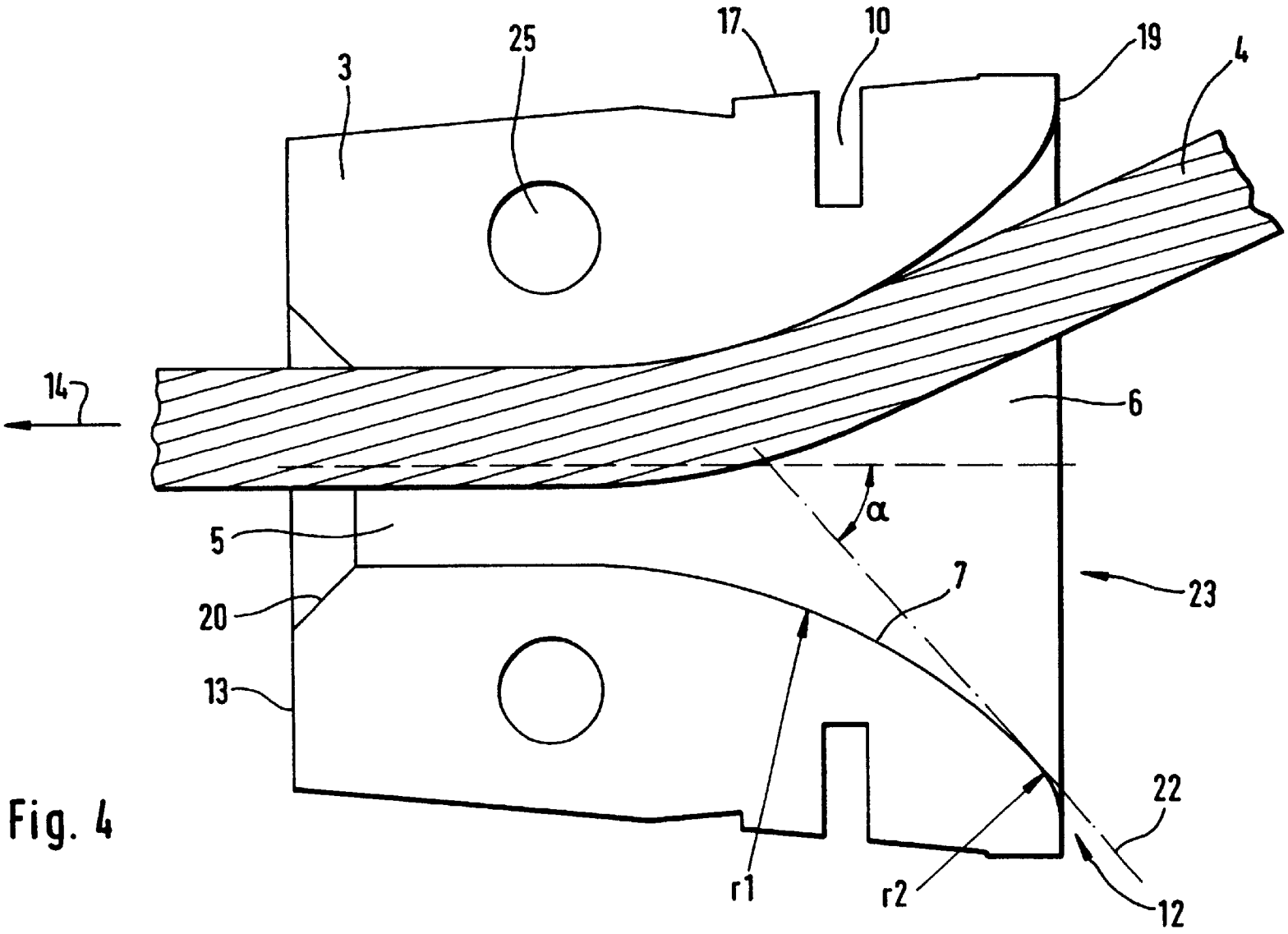
FIG. 4 shows one half of the insert of the inventive cable guide arrangement with the cable positioned therein.

FIG. 4 shows a plan view onto the separation plane of a component half 3 of the guide sleeve (insert 2) with a cable 4 positioned therein. The traction cable 4 is guided by the wall of the guide channel 5 penetrating the sleeve or insert 2. The cable guide channel 5 widens to form a funnel shape at the end face 12 facing away from the cable winch. The shaping of the channel wall 7, especially in the area of the inlet funnel 6, ensures a safe cable guiding action into the cable winch with minimal wear under pulling load conditions of the cable winch.

The funnel wall 7 of the inlet funnel 6 is widened like the flared bell of a trumpet and is curved inwardly, i.e., in the direction toward the interior of the channel, so that the inlet funnel 6 has substantially the shape of a trumpet. The cable 4 is thus guided from any possible deflection position relative to the longitudinal axis 21 of the cable guide arrangement into the circumferential closed guide channel 5, i.e., a channel describing an arc angle of 360°. When the cable winch pulls in the direction of arrow 14, the cable 4 is guided with minimal frictional forces along the hyperbola-shaped channel wall 7 through the cable guide arrangement, even when arriving at the cable guide arrangement in a slanted pulling position.

The funnel wall 7 has different curvature radii r1, r2 wherein the radius r2 of the wall portion which is closer to the funnel opening 23 is smaller than the radius r1. The center points of the radii are located outside of the inlet funnel. In the embodiment represented in FIG. 4 a hyperbola-shaped funnel wall 7 is shown having a radius of curvature that continuously decreases in the direction toward the funnel opening 23. It may also be advantageous to form the funnel wall 7 with a single radius of curvature or to provide two or more radii of curvature and to arrange the respective curvature portions adjacent to one another to form a continuous curve. A tangent 22 of the wall curvature near its end, i.e., near the circumferential edge 19 of the final opening 23, can be positioned at an angle $\alpha$ of up to 90°, or optionally even more oblique, to the longitudinal center axis 21 of the cable guide channel 5. During operation of the cable winch extreme slanted pulling positions of the cable 4 relative to the orientation of the cable guide arrangement are thus possible according to the angle $\alpha$ between the curvature tangent 22 and. the longitudinal center axis 21 so that the cable 4 is pulled with minimal friction through the cable guide arrangement. For conventional deflection angles of 10° or less the cable experiences substantially reduced wear in comparison to prior art arrangements. The outer edge 19 of the end face 12 of the insert 2 is expediently rounded. The two-part guide sleeve (insert) 2 is comprised in the shown embodiment of plastic, preferably, polyamide. Other materials such as metal or wood or others can also be suitable.

The sleeve halves 3, 3' can be produced in large numbers inexpensively as injection molded parts, especially in the shown identical configuration with bores 25 arranged in pairs for receiving the connecting pins 24. On both sides of the longitudinal center axis 21 of the sleeve halves 3, 3' several pairs of bores 25 can be provided. The manufacture of the sleeve halves 3, 3' of solid material (free of hollows), such as for metal or wood inserts 2, can also be advantageous for an insert 2 made of plastic, for example, with respect to production-technological considerations.

The cable guide arrangement according to the invention is comprised of only a few lightweight parts. The total weight of the cable guide arrangement is thus very low, which is especially advantageous for use of the cable guide arrangement in connection with portable cable winches, for example, on vehicles. Assembly of the cable guide arrangement is realized with only a few and lightweight parts to be combined. The outlet of the guide channel 5 at the end face 13 of the insert 2 facing the cable winch is provided with a bevel 20 and is thus protected against increased frictional wear caused by the cable passing through.

While specific embodiments of the invention have been shown and described in detail to illustrate the inventive principles, it will be understood that the invention may be embodied otherwise without departing from such principles.

What is claimed is:

1. A cable guide arrangement for a cable winch, said cable guide arrangement comprising:

a housing (1) having a first end and a second end;

a cable guide channel (5) penetrating said housing (1) and having a closed circumferential wall (7);

an insert (2) detachably mounted in said housing (1) in a secured position without being moveable relative to the housing (1) in the secured position, wherein said cable guide channel (5) is arranged in said insert (2);

said cable guide channel (5) having a longitudinal center axis (21) extending perpendicularly to said first and second ends of said housing (1);

said cable guide channel (5) having open end portions at said first and second ends of said housing (1), respectively;

said open end portion (6) of said cable guide channel (5) at said second end of said housing (1) widening in a direction away from said first end of said housing (1) to form an inlet funnel (6) having an edge portion (19) defining a funnel opening (23).

2. The cable guide arrangement according to claim 1, wherein said inlet funnel (6) has a funnel wall (7) having an inwardly curved curvature when viewed in section in a direction of said longitudinal center axis (21).

3. The cable guide arrangement according to claim 2, wherein said inwardly curved curvature of said funnel wall (7) is composed of curvature portions having different radii ($r_1$, $r_2$), wherein said different radii ($r_1$, $r_2$) decrease in a direction toward said funnel opening (23).

4. The cable guide arrangement according to claim 2, wherein a tangent (22) of said inwardly curved curvature of said funnel wall (7) adjacent to said edge portion (19) is positioned at an angle $\alpha$ of 30° to 90° relative to said longitudinal center axis.

5. The cable guide arrangement according to claim 1, wherein said insert (2) is an injection molded part.

6. The cable guide arrangement according to claim 1, wherein said insert (2) is made of plastic.

7. The cable guide arrangement according to claim 1, wherein said insert (2) is made of wood.

8. A cable guide arrangement for a cable winch, said cable guide arrangement comprising:

a housing (1) having a first end and a second end;

a cable guide channel (5) penetrating said housing (1) and having a closed circumferential wall (7);

an insert (2) detachably mounted in said housing (1), wherein said cable guide channel (5) is arranged in said insert (2);

said cable guide channel (5) having a longitudinal center axis (21) extending perpendicularly to said first and second ends of said housing (1);

said cable guide channel (5) having open end portions at said first and second ends of said housing (1), respectively;

said open end portion (6) of said cable guide channel (5) at said second end of said housing (1) widening in a direction away from said first end of said housing (1) to form an inlet funnel (6) having an edge portion (19) defining a funnel opening (23);

wherein said insert (2) is comprised of two insert halves (3, 3').

9. A cable guide arrangement for a cable winch, said cable guide arrangement comprising:

a housing (1) having a first end and a second end;

a cable guide channel (5) penetrating said housing (1) and having a closed circumferential wall (7);

an insert (2) detachably mounted in said housing (1), wherein said cable guide channel (5) is arranged in said insert (2);

said cable guide channel (5) having a longitudinal center axis (21) extending perpendicularly to said first and second ends of said housing (1);

said cable guide channel (5) having open end portions at said first and second ends of said housing (1), respectively;

said open end portion (6) of said cable guide channel (5) at said second end of said housing (1) widening in a direction away from said first end of said housing (1) to form an inlet funnel (6) having an edge portion (19) defining a funnel opening (23);

wherein said insert (2) has a conical outer mantle surface (17) and wherein said housing (1) has a conical inner mantle surface (1*a*) configured to accommodate said conical outer mantle surface (17) of said insert (2).

10. The cable guide arrangement according to claim 8, wherein a narrow end of said conical outer mantle surface (17) is positioned at said first end of said housing (1).

11. The cable guide arrangement according to claim 8, further comprising fastening elements (8) configured to detachably mount said insert (1) in said housing (1), wherein said conical outer mantle surface (17) has one or more cutouts (10) and wherein said fastening elements (8) secure said insert (2) in said housing (1) by engaging said one or more cutouts (10).

12. The cable guide arrangement according to claims 11, wherein several of said cutouts (10) are arranged about the circumference of said conical outer mantle surface (17) with equal rotational angle spacing relative to one another.

* * * * *